United States Patent [19]

Katayama et al.

[11] 4,387,436

[45] Jun. 7, 1983

[54] METHOD AND APPARATUS FOR DETECTING ELEVATOR CAR POSITION

[75] Inventors: Yasunori Katayama, Hitachi; Takanobu Hatakeyama, Katsuta; Seiya Shima, Katsuta; Sadao Hokari, Katsuta; Toshiro Narita, Hitachi; Kenji Yoneda, Katsuta; Kazuhiro Sakata, Katsuta; Tomiaki Kurihara, Katsuta; Toshio Meguro, Katsuta, all of Japan

[73] Assignee: Hitachi, Ltd., Tokyo, Japan

[21] Appl. No.: 208,579

[22] Filed: Nov. 20, 1980

[30] Foreign Application Priority Data

Nov. 22, 1979 [JP] Japan ..... 54-151357

[51] Int. Cl.[3] ..... B66B 3/02

[52] U.S. Cl. ..... 364/561; 187/29 R; 340/21

[58] Field of Search ..... 364/167, 170, 174, 183, 364/400, 561, 571; 187/29 R; 340/19 R, 21

[56] References Cited

U.S. PATENT DOCUMENTS

| | | | |
|---|---|---|---|
| 3,589,474 | 6/1971 | Wavre | 187/29 R |
| 3,590,355 | 6/1971 | Davis | 187/29 R |
| 3,773,146 | 11/1973 | Dixon, Jr. et al. | 187/29 R |
| 4,108,282 | 8/1979 | Satoh et al. | 187/29 R |
| 4,134,476 | 1/1979 | Zolnerovich, Jr. et al. | 187/29 R |
| 4,141,435 | 2/1979 | Satoh | 187/29 R |
| 4,150,734 | 4/1979 | Ohira et al. | 187/29 R |
| 4,218,671 | 8/1980 | Lewis | 340/21 |

FOREIGN PATENT DOCUMENTS

| | | | |
|---|---|---|---|
| 54-115852 | 9/1979 | Japan | 340/21 |

*Primary Examiner*—Gary Chin

*Attorney, Agent, or Firm*—Antonelli, Terry & Wands

[57] ABSTRACT

A pulse generator is coupled to a car drive motor directly coupled to a sheave, over which a rope suspending an elevator car is passed, and the position of the car is calculated through the counting of pulses produced from the pulse generator. First and second car position detectors for detecting respective first and second car positions are provided within a hatchway, and the number of pulses produced during a period from the actuation of the first car position detector till the actuation of the second car position detector is detected. A count value for calculating the car position is corrected according to the difference between the detected pulse number and a reference pulse number corresponding to the distance between the first and second car position detectors, thereby effecting the compensation for the wear of the sheave and rope to improve the precision of the car position detection.

8 Claims, 13 Drawing Figures

FIG. 5A

| ADDRESS | DATA |
|---|---|
| $A_1$ | TIMER FLAG |
| $A_2$ | CONTENT OF PTM-C |
| $A_3$ | PRESENT CAR POSITION |
| $A_4$ | DIRECTION OF TRAVEL OF CAR |
| | |
| $A_{10}$ | CONTENT OF PTM-C AT APPEARANCE OF POSITION SIGNAL B |
| $A_{11}$ | MEASUREMENT |
| $A_{12}$ | CORRECTION UNIT |
| $A_{13}$ | REMAINDER OUTPUT |
| $A_{14}$ | REMAINDER INPUT |
| $A_{15}$ | STATISTICAL MEASURED PULSE NUMBER |
| $A_{16}$ | TRAVELED DISTANCE A |
| | |

FIG. 5B

| ADDRESS | DATA |
|---|---|
| $A_{50}$ | REFERENCE PULSE NUMBER |
| | |

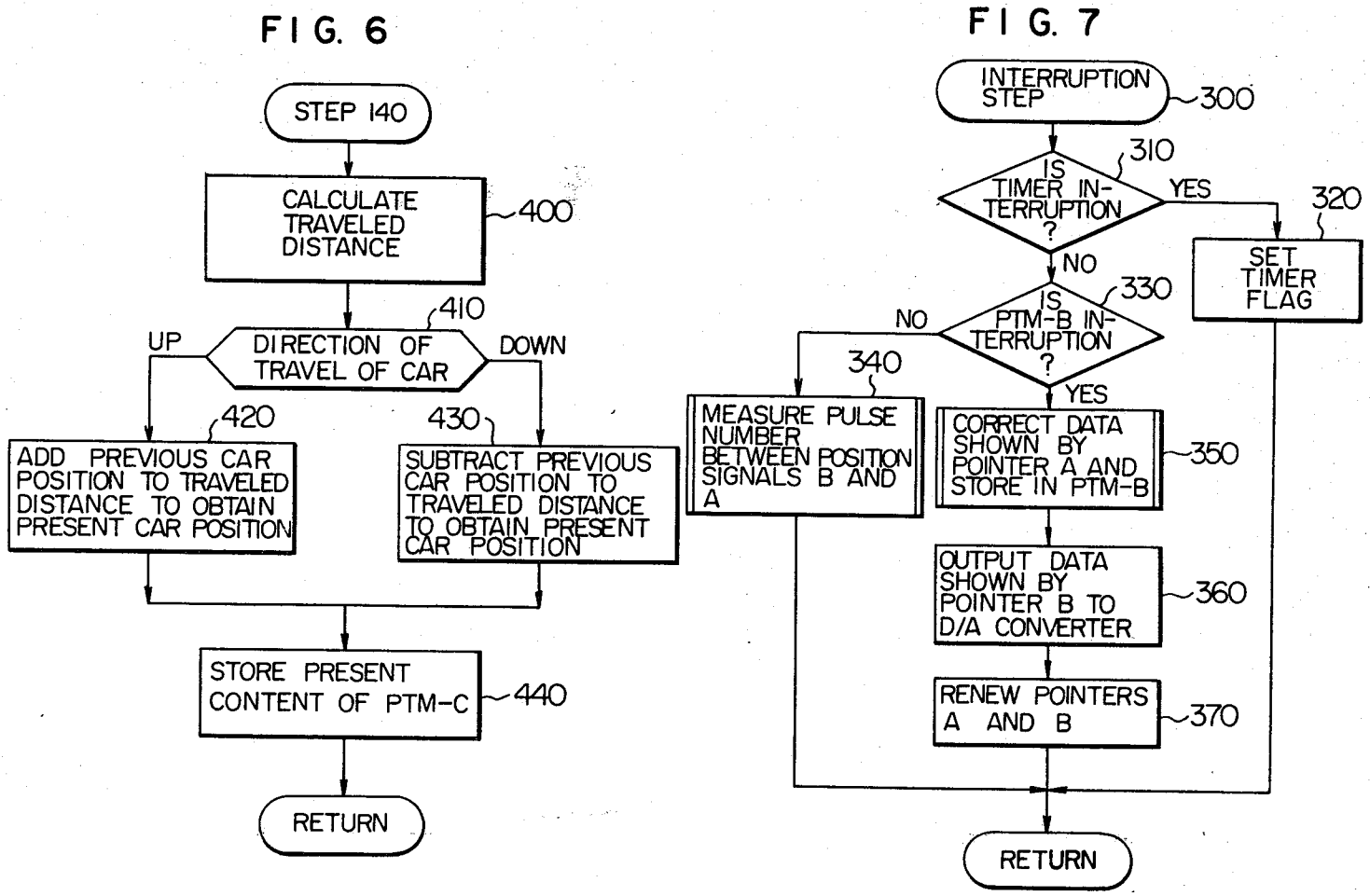
FIG. 7
INTERRUPTION STEP
300
IS TIMER INTERRUPTION ?
310
YES
NO
SET TIMER FLAG
320
IS PTM-B INTERRUPTION ?
330
YES
NO
CORRECT DATA SHOWN BY POINTER A AND STORE IN PTM-B
350
OUTPUT DATA SHOWN BY POINTER B TO D/A CONVERTER
360
RENEW POINTERS A AND B
370
MEASURE PULSE NUMBER BETWEEN SIGNALS A AND B
340
RETURN
FIG. 6
STEP 140
CALCULATE TRAVELED DISTANCE
400
DIRECTION OF TRAVEL OF CAR
410
UP
DOWN
ADD PREVIOUS CAR POSITION TO TRAVELED DISTANCE TO OBTAIN PRESENT CAR POSITION
420
SUBTRACT PREVIOUS CAR POSITION TO TRAVELED DISTANCE TO OBTAIN PRESENT CAR POSITION
430
STORE PRESENT CONTENT OF PTM-C
440
RETURN

METHOD AND APPARATUS FOR DETECTING ELEVATOR CAR POSITION

This invention relates to method and apparatus for detecting the elevator car position.

Recently, systems for electrically detecting the elevator car position, for instance as disclosed in U.S. Pat. Nos. 4,150,734 and 3,589,474, have been proposed and put to practical use in place of systems of mechanically detecting the elevator car position. In these systems, a pulse generator coupled to an elevator car drive motor or a portion rotating in an interlocked relation to the car is provided, and the car position is digitally detected from the pulse output of the pulse generator. The pulse generator is one which produces pulses in proportion to the afore-mentioned rotation as is well known in the art, or a system using an AC speed generator, the AC output of which is shaped for conversion into a pulse signal, is employed, as disclosed in U.S. Pat. No. 4,150,734 mentioned above. The pulses produced from the pulse generator can therefore be thought to be proportional to the distance traveled by the car. According to U.S. Pat. No. 3,589,474, the generated pulses are arithmetically processed to derive the present car position and advance position, and the control of the car is effected on the basis of the car position thus derived.

Generally, there is a power transmission mechanism between the pulse generator and car. For example, in the system disclosed in the U.S. Pat. No. 4,150,734, in which the pulse generator is coupled to a car drive motor, a sheave and a rope are present. Such power transmission mechanism is subject to wear in long use, thus leading to errors between the detected car position obtained through the arithmetic processing of the generated pulses and the actual car position. Therefore, where the elevator car is controlled on the basis of the detected car position, even if proper adjustment is made at the time of the installation so that there is no landing error of a stop position of the car with respect to each floor, generation and progressive increase of the landing error is prone to occur in long use. The landing errors generated cause discomfort to passengers.

A first object of the invention is to provide a method of highly precisely detecting the car position in a system in which the car position is calculated through the counting of output pulses from a pulse generator which is coupled through a power transmission mechanism to the car.

A second object of the invention is to provide an apparatus for car position detection, which is suited for highly precisely detecting the car position mentioned above.

It is a first feature of the invention to correct the afore-mentioned detected car position according to the difference between the number of generated pulses obtained when a predetermined distance is traveled by the car and a predetermined reference value.

The second feature of the invention lies in a car position detection system, which comprises a detector for detecting first and second car positions in a hatch, a means for previously memorizing a reference pulse number corresponding to the distance between the first and second car positions mentioned, and a means for detecting the number of pulses produced during the travel of the car between the first and second positions, and in which the detected car position obtained through the counting of the generated pulses is corrected according to the result of comparison of the memorized pulse number and detected pulse number.

The above and other objects and features of the invention are attained in various forms in the embodiments of the invention, which will be described in detail hereinunder.

In the drawing

FIGS. 1 through 13 illustrate one embodiment of the invention, and in which:

FIG. 1 is a block diagram, partly in schematic, showing the overall construction of an elevator system according to the invention;

FIG. 2 is a block diagram showing an elevator system control computer;

FIG. 3 is a block diagram of a programmable timer module (PTM) of part of the elevator system control computer;

FIG. 4 is a flow chart illustrating a live program of the elevator system control computer;

FIGS. 5A and 5B are respectively a memory map stored in a RAM and a memory map stored in a ROM;

FIG. 6 is a flow chart illustrating a processing program for deriving the calculated car position;

FIG. 7 is a flow chart illustrating an interruption processing program;

FIG. 9 is a flow chart illustrating the process program for determining the number of the pulses generated during the movement of the car from the appearance of a position signal A till the appearance of a position signal B;

FIG. 10 is a flow chart illustrating the process program for determining the amount of correction;

FIG. 11 is a flow chart illustrating the process program for calculating the distance traveled;

FIG. 12 is a flow chart illustrating the process program for storage in PTM-B; and FIG. 13 is a flow chart illustrating the process program for determining the extent of wear.

Figure 1:
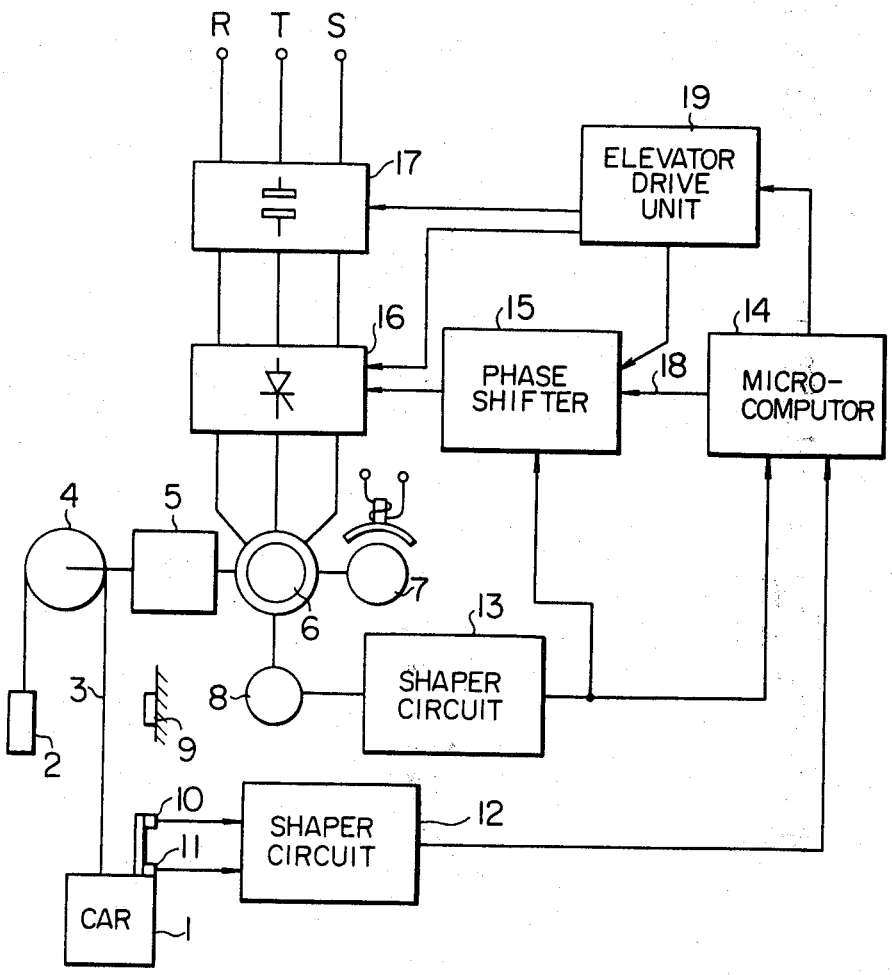

FIG. 1 shows a block diagram for illustrating the overall construction of the elevator system according to the invention. An elevator car 1 and a counterweight 2 are suspended like well buckets by a rope 3 passed over a sheave 4. The sheave 4 is coupled through a speed reduction gear means 5 to a three-phase induction drive motor 6 and also to a magnetic brake 7, and an AC speed generator 8 is coupled to the induction motor 6 for producing pulses in proportion to the distance covered by the car 1.

Figure 2:
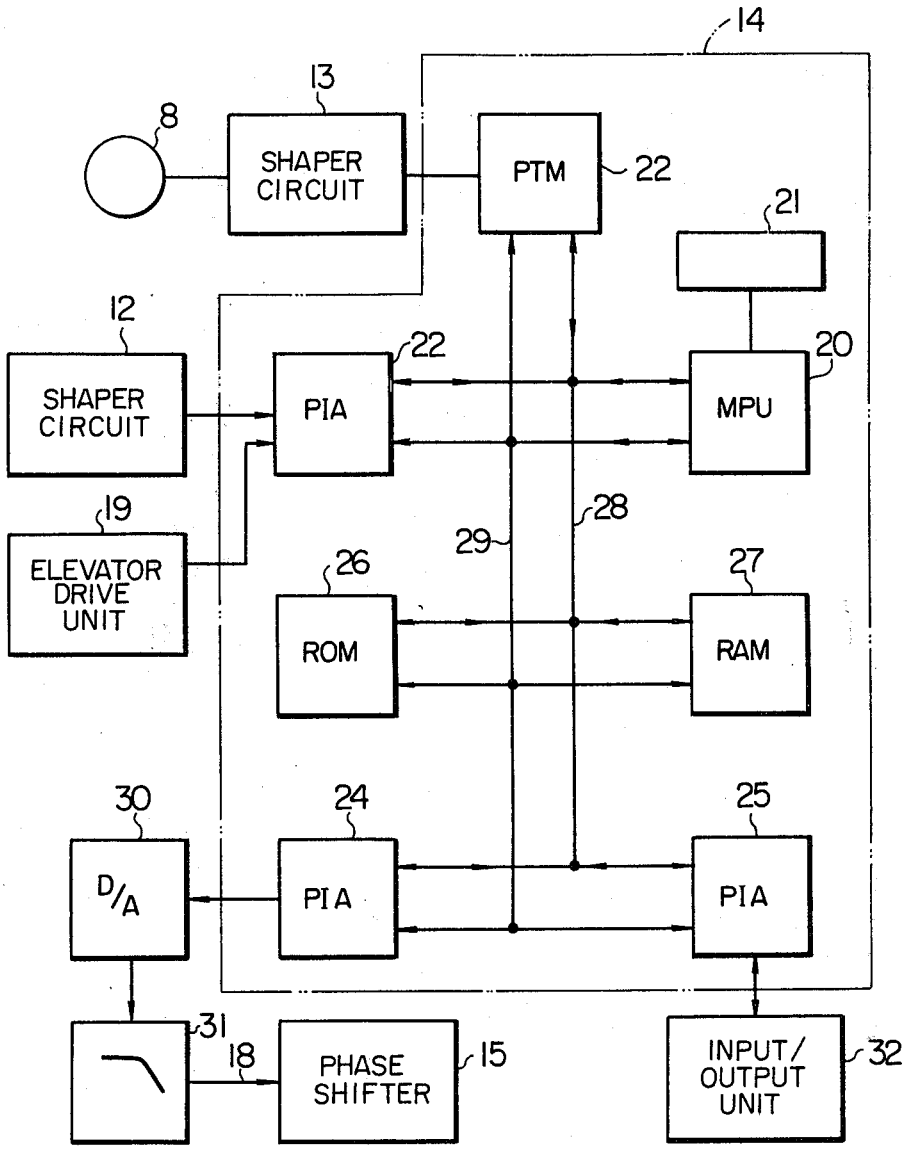

Designated at R, T and S are three-phase AC power source terminals, which are connected through a main switch circuit 17 to a thyristor control unit 16. The main switch circuit 17 has switches which are appropriately combined for up and down operations, maintenance operation, normal operation, etc. The thyristor control unit 16 has thyristors or combinations of thyristors and switches, and it is controlled by a phase shifter 15. The phase shifter 15 effects feedback control by receiving a signal from the speed generator 8 through an elevator system control computer, for instance a microcomputer 14 as shown in FIG. 2. Through this feedback control, the elevator car 1 can be moved at a speed corresponding to a speed command 18 produced from the elevator system control computer 14.

The speed command 18 is produced by the elevator system control computer 14 from a position signal produced from a shaper circuit 12, outputs of the speed generator 8 and an elevator drive unit 19 and an internal clock.

Position detectors 10 and 11 are actuated when they pass by a shield plate 9 provided in the hatch, and their outputs are coupled through the shaper circuit 12 to the elevator system control computer 14.

The AC speed generator 8 (hereinafter referred to as ACSG) produces a pulse every time a predetermined distance is covered by the elevator car 1, and hence the distance traveled by the car can be known from the number of pulses produced from the ACSG 8. The pulses produced from the ACSG 8 are coupled through a shaper circuit 13 to the elevator system control computer 14.

The elevator system control computer 14 is a microcomputer as shown enclosed within a dashed rectangle in FIG. 2, and includes a microprocessor unit 20 (hereinafter referred to as MPU), a clock unit 21 for determining the operation timing of the MPU 20 and for informing the MPU 20 of the lapse of a predetermined time interval, a programmable timer counter (hereinafter referred to as PTM) 22 for counting pulses coupled to the microcomputer 14, peripheral interfaces (hereinafter referred to as PIA) 23, 24 and 25 for supplying and receiving external signals coupled from and to the microcomputer 14, a read only memory (hereinafter referred to as ROM) 26 in which the procedure of operation of the MPU 20 is memorized, a random access memory (hereinafter referred to as RAM) 27 used as the working area of the MPU 20 for temporary storage, a data bus 28 through which data is transferred from the individual component elements to one another, and a control bus 29 which is used for selecting memory addresses and elements and also for the transfer of interrupt signals and other signals. The output signal coupled from the ACSG 8 through the shaper circuit 13 sets a register in the PTM 22 such that a flag is set therein upon detection of the rising or falling of the signal. The position signal from the shaper circuit 12 is coupled to the PIA 23. The speed command 18 is produced as the output of the PIA 24 from the microcomputer 14 and is coupled through a digital-to-analog converter 30, which converts the digital signal to an analog signal, and a filter circuit 31. An output produced as a result of operation of a control board or the like by elevator maintenance personnel is coupled through an input/output unit 32 to the PIA 25.

The operation of the PTM 22 will be described with reference to the block diagram of FIG. 3.

The PTM 22 is connected to the data bus 28 of the microcomputer 14 and also to the control bus 29 which includes clock and address buses. It also receives the output of the ACSG 8 coupled through the shaper circuit 13.

Data coupled from the MPU 20 through the data bus can be coupled through a buffer 53 and registered in a control register 50 and a latch 52. Data in a counter 51 and data in a flag register 61 are read out through the buffer register 53 to the MPU 20.

The PTM 22 can be used in various modes according to the data registered in the control register 50 as is well known in the art. Here, its functions necessary for the car position detection and speed command generation will be discussed.

In a first mode, the operation is started when a reset signal coupled through the control bus 29 is received by the control register 50 or when a particular bit of the control register is reduced to zero. At this time, the data registered in the latch 52 is stored in the counter 51. At the same time, an internal clock signal coupled through the control bus 29 is coupled to a signal line 62, and a clock select switch 60 is switched to the side of the signal line 62. In this state, every time the trailing edge of the internal clock signal is detected, the count of the counter 51 is reduced. As soon as "1" is subtracted from zero, an interrupt signal is output to the control bus 29, thereby setting an interrupt flag in the flag register 61. When the interrupt flag is set in the flag register 61, the content of the latch 52 is stored in the counter 51, and then the content of the counter is progressively reduced according to the internal clock.

The writing of data in the latch 52 may be done with any timing.

A command code for causing the above operation is stored in the control register 50 so that the PTM 22 may be used for producing a speed command at the time of acceleration.

In a second mode, the select switch 60 is switched such that external clock is selectively coupled to the counter 51, while a command code like that in the case of the first mode is stored in the control register 50.

By so doing, the PTM 22 can count pulses from the ACSG 8 at the time of deceleration and hence can be used as a deceleration command generator.

In a third mode, the maximum value of the latch, for instance a 16-step FFFF in case when the counter 51 is a 16-bit counter, is stored, and external clock is selectively coupled to the counter 51. In this way, the counter is allowed to produce no interrupt signal as mentioned above even if the condition for producing an interrupt signal is met. Also, when the content of the counter 51 is further reduced by "1" from zero, a value "FFFF" is coupled from the latch so that the resultant count is equivalent to "1" less than the 16-step number "10000". In this case, the counter can count to provide in effect values in excess of 17 bits although it is actually a 16-bit counter. Further, the content of the counter 51, like that of a memory, can be fetched by the MPU 20 at any time (provided in synchronism to the clock of the microcomputer 14) and be used for determining the distance traveled by the car 1.

Figure 3:
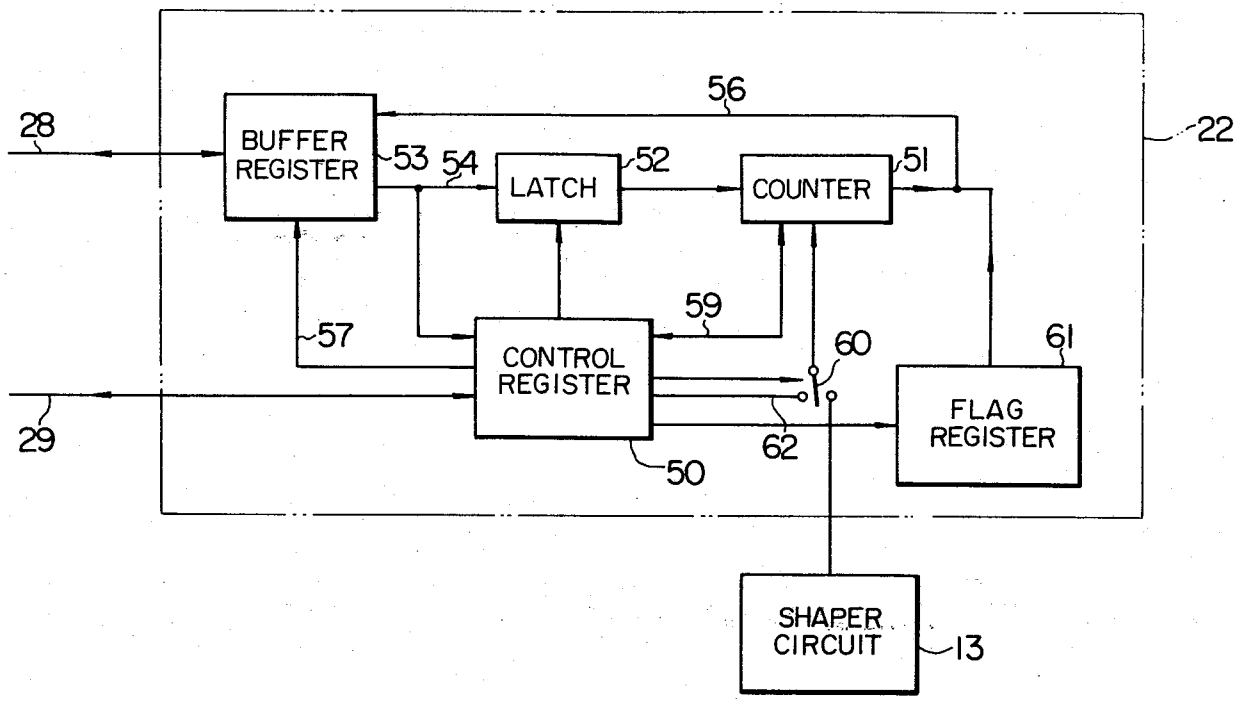

It is to be thought, therefore, that the PTM 22 has three timer counters of the construction as shown in FIG. 3. These timer counters are referred to as PTM-A, PTM-B and PTM-C respectively. The PTM-A is used for the acceleration control in the afore-mentioned first mode of the PTM 22 using the internal clock. The PTM-B is used in the second mode based upon the pulses produced from the ACSG 8, that is, used as a speed command generator at the time of the deceleration of the car. The PTM-C is used for determining the traveled distance in the third mode using the external clock as in the case of the PTM-B.

The microcomputer 14 of the above construction operates according to a procedure program (hereinafter referred to as program) stored in the ROM 26.

Figure 4:
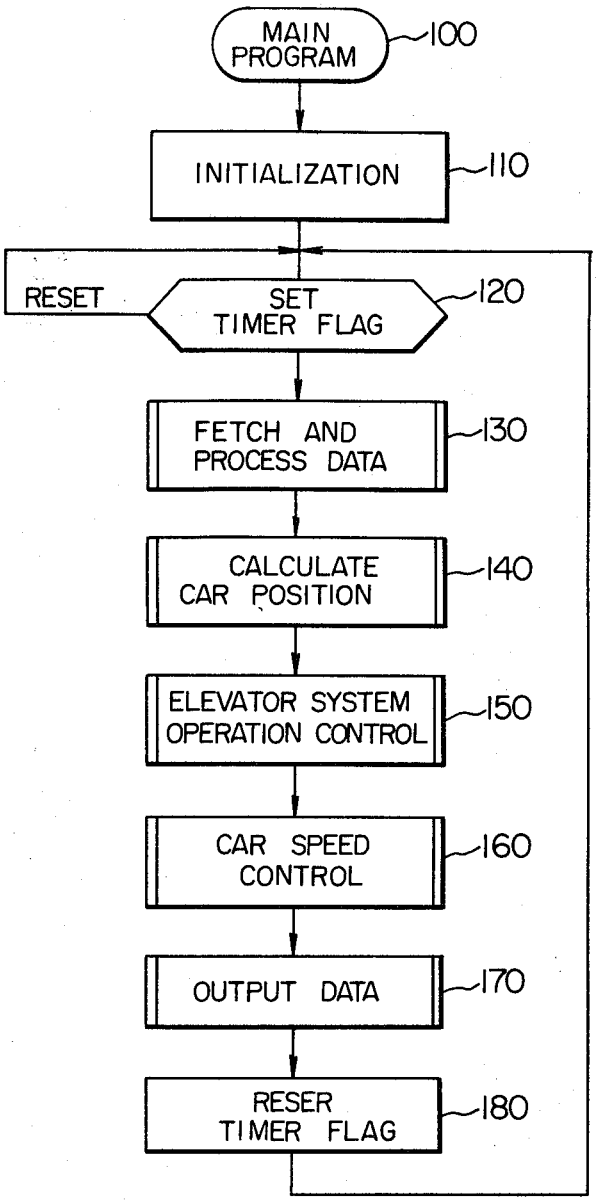

FIG. 4 shows the main program 100 stored in the ROM 26. In a step 110, which is an initialization step, the PTM 22, PIAS 23, 24 and 25 and timer 21 are initialized and also setting and resetting of flags and setting of data required for the operation of the elevator system are effected after the closure of the power source or at the time of the resumption after a trouble is over. In a step 120, judging is done on whether a timer flag is set or not. The timer flag is set by an interrupt signal which is produced by the timer 21 every time interval T for sequentially operating various jobs of the elevator. If the timer flag is set, the program goes to a step 130. If the flag remains reset, the step 120 is caused to be executed again. In the step 130, outputs from various switches and sensors of the elevator system are fetched, and the setting and resetting of flags are effected in accordance with the fetched input signals. In a step 140, the car position is calculated from the content of the PTM 22. Subsequently, in a step 150 the operation of the elevator system is controlled in accordance with various inputs and the results of various calculations; in a step 160, which is a speed control step, the car speed is controlled to ensure the comfort of the passengers; in a step 170 the data obtained through the steps 140 to 160 are output from the microcomputer 14 to the elevator drive unit 19 and phase shifter 18; and in a step 180 the timer flag is reset before returning to the step 120.

The total processing time required for the steps 130 through 180 is set to be within the aforementioned time period T unless there occurs any trouble in the microcomputer 14.

FIGS. 5A and 5B show memory maps for storing data to be used in accordance with the invention. FIG. 5A shows a memory map of the RAM 27, and FIG. 5B shows a memory map of the ROM 26. Various data to be described later are memorized in memory areas corresponding to the respective addresses. Here, only the memory maps for the data to be used in accordance with the invention are shown, and the other memory maps are omitted.

Now, a car position calculation process will be discussed. As an example calculations of the present car position and the car position from which to cause deceleration when producing a deceleration command will be described in detail.

FIG. 6 shows a detailed flow chart of the car position calculation step 140 shown in FIG. 4. As has been described in connection with FIG 4, this step 140 is executed for every time period T. Referring to FIG. 6, in a step 400, which is a traveled distance calculation step, the distance traveled by the car during the afore-mentioned time period T is calculated. In this embodiment, the detected car position is corrected through the correction of the traveled distance, and the step 400 will be discussed in detail with reference to FIG. 11. In summary, the distance traveled by the car during the time period T is calculated through the subtraction of the present data registered in the PTM-C from the data of the PTM-C the period T earlier and stored in the address $A_2$ shown in FIG. 5 and correction of the resultant value. In a step 410, the direction of travel of the car stored in the address $A_4$ shown in FIG. 5 in the step 130 is checked. If the direction is up a step 420 is executed, while if the direction is down a step 430 is executed. In the step 420, which is an uptraveling car position detection step, the present car position is obtained through the addition of the traveled distance as obtained in the step 400 and the memorized car position the period T earlier memorized in the address $A_3$ shown in FIG. 5, and the result thus obtained is stored in the address $A_3$ shown in FIG. 5. In the step 430, which is a down-traveling car position detection step, the present car position is obtained through the subtraction of the traveled distance from the car position the period T earlier, and the result thus obtained is stored in the address $A_3$ shown in FIG. 5. In a step 440, the content of the PTM-C is read out and stored in the address $A_2$ shown in FIG. 5.

In the step 400, even if the content of the PTM is greater than the earlier content, at which time the microcomputer 14 automatically produces a borrow signal, this is the same as if the highest bit of a counter having another higher bit position is changed from "1" to zero.

When an interrupt signal is coupled to the MPU 20 while the microcomputer 14 is performing the process of the steps 120 through 180, the MPU 20 stops the step having been in force and executes an interrupt process 300 as shown in FIG. 7. When the interrupt process is ended, it again takes the interrupted job.

FIG. 7 shows a flow chart of the interrupt process executed in response to the interrupt signal. While the speed command calculation process at the time of deceleration is described in detail, steps 340 and 350 in this process, will be discussed later in detail with reference to FIGS. 9 and 12. Referring to FIG. 7, in a step 310 whether the interruption is from the timer 21 is checked. If the interruption is from the timer 21, a step 320 is executed, and otherwise a step 330 is executed. In the step 320, which is executed in response to the interruption from the timer, the timer flag is set in the address $A_1$ shown in FIG. 5A. As a result, the steps 130 to 180 in FIG. 4 are executed. In the step 330, whether the interruption is from the PTM-B is checked. If the interruption is not from the PTM-B, the step 340 is executed, while otherwise the step 350 is executed. In the step 340, the number of pulses produced while the position detectors 10 and 11 shown in FIG. 1 are passing by the shield plate 9 (i.e., during a period during which a predetermined distance is covered by the car 1) is detected and compared with a reference value to determine the amount of correction. This step will now be discussed in greater detail with reference to FIGS. 9 and 10. The position detectors 10 and 11 are actuated by the shield plate 9 in different orders depending upon the direction of movement of the car. Of the two position signals produced from the position detectors 10 and 11, the earlier one is referred to as position signal B, and the later one is referred to as position signal A.

Figure 8A:
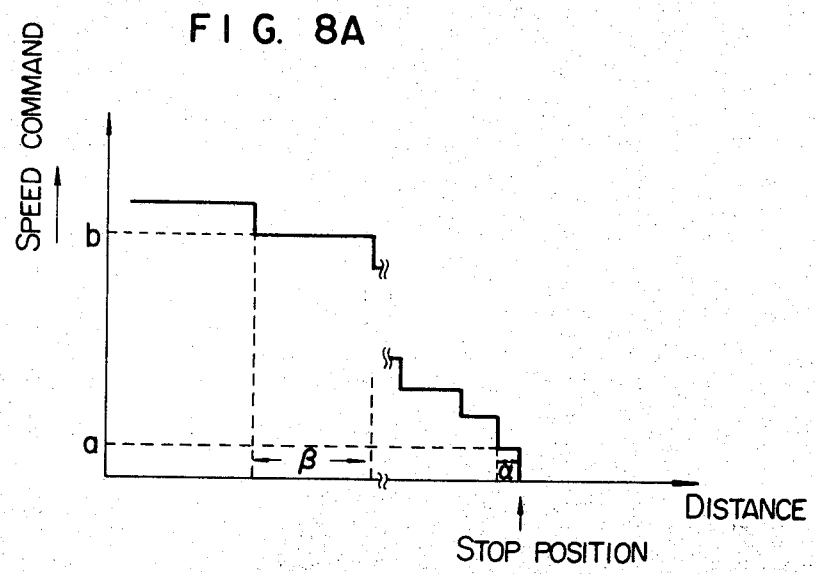
FIGS. 8A and 8B are respectively a speed command diagram illustrating the deceleration command calculation process and a memory map of data used in this process.
Figure 8B:
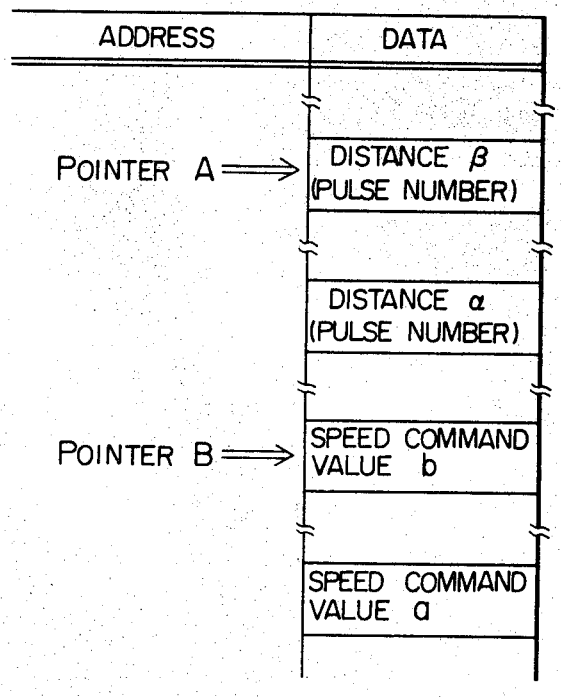

Steps 350 through 370 are executed for producing a speed command at the time of the deceleration as shown in FIG. 8A in response to the interruption from the PTM-B. In FIG. 8A, the ordinate is taken for the value of the speed command, and the abscissa is taken for the distance to be covered. As is seen, the command value is progressively reduced as the car is moved to an extent corresponding to the count value set in the PTM-B. FIG. 8B shows a memory map for the distance and speed command value data which are used at this time. This data is stored in the ROM 26.

Figure 12:
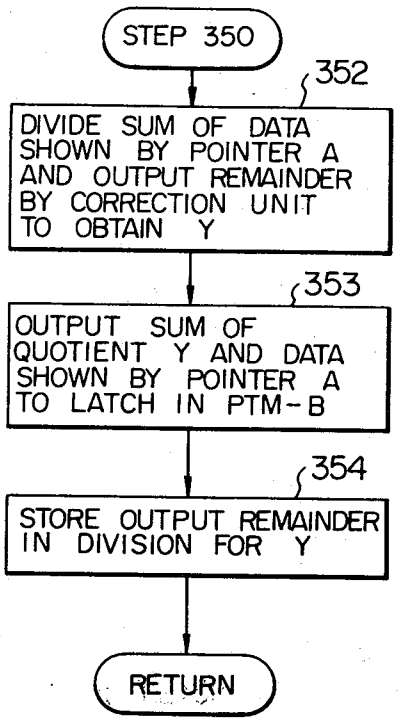

As mentioned earlier, in the PTM-B the preset count value is progressively reduced according to the pulses produced from the ACSG 8, and an interrupt signal is produced when the count is reduced to zero. Thus, it is possible to detect a desired car position at the time of deceleration by setting the aforementioned count to an appropriate value. In the step 350, the next count to be set in the PTM-B is stored in the latch of the PTM-B in response to an interrupt signal from the PTM-B. Here, the car position at the time of the deceleration is corrected through the correction of the count to be set in the PTM-B. FIG. 12 shows the detail flow chart of this step. Briefly, the distance data shown by pointer A as shown in FIG. 8B is corrected and stored in the PTM-B.

In the step 360, the speed command value shown by pointer B at this time is output to the digital-to-analog converter 30. In the step 370, the pointers A and B are renewed to the addresses of data to be provided when the next interruption from the PTM-B is produced.

It will be seen that in the above process successive car deceleration positions are detected to produce deceleration commands as shown in FIG. 8A through the counting of pulses produced from the ACSG 8.

FIGS. 9 through 12 are detail flow charts for the process of correcting the present position and deceleration position of the car.

Figure 9:
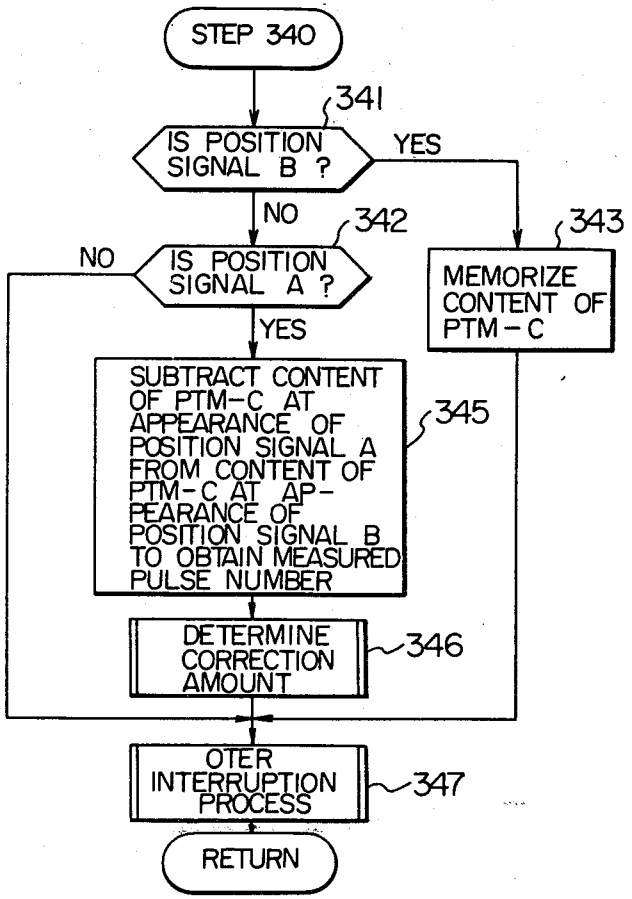

FIG. 9 is a detail flow chart of the step 340 shown in FIG. 7. The position detectors 10 and 11 shown in FIG. 1 are secured to the car, that is, they are spaced apart a predetermined distance. When the car is traveling up, the position detector 10 passes by the shield plate 9 prior to the detector 11 to produce a position signal, which is referred to as position signal B. At this time, the subsequently produced actuation signal from the position detector 11 is referred to as position signal A. When the car is traveling down, the actuation signal produced from the position detector 11 is referred to as position signal B, and that from the position detector 10 is referred to as position signal A. In a step 341, whether the position signal B is produced is checked. If the position signal B is produced a step 343 is executed, and otherwise a step 342 is executed. In the step 342, whether the position signal A is produced is checked. If the position signal A is produced, a step 345 is executed, and otherwise a step 347 is executed. In the step 343, the content of the PTM-C at the time of the generation of the position signal B is stored in the address $A_{10}$ shown in FIG. 5. In the step 345, the content of the PTM-C at the time of the appearance of the position signal A is subtracted from the content of the PTM-C at the time of the appearance of the position signal B, and the result is stored as measured number of pulses in the address $A_{11}$. In the step 346, the amount of correction of the number of pulses from the ACSG 8 is determined. The step 347, which is executed in response to other interruptions, is irrelevant to the invention, so it is not discussed.

Figure 10:
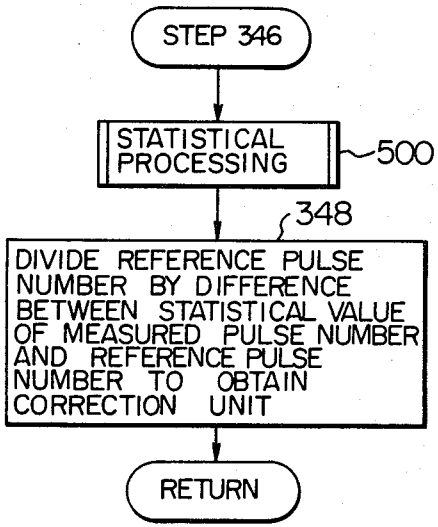

FIG. 10 shows the step 346. It consists of a statistical processing step 500 and a correction unit calculation step 348.

In the statistical processing step 500, effects of external noise or erroneous counting in the counter on the measured pulse number obtained in the step 345 are cancelled. The aim of this step is to promote the precision of the measured pulse number. As a general means to achieve this end, it is possible to derive an average value of several measured pulse numbers.

In the correction unit calculation step 348, the reference pulse number is the number of pulses produced from the ACSG 8 during a period from the appearance of the position signal B till the appearance of the position signal A in the case when the car is moved in the state of no wear in the power transmission mechanism such as sheaves. It can thus be obtained at the time of the design through calculation from the distance between the positions corresponding to the instants of appearance of the position signals B and A and the distance covered by the car until the appearance of each pulse from the ACSG 8. It is stored in the address $A_{50}$ shown in FIG. 5B. In the step 348, the correction unit is calculated through division of the afore-mentioned reference pulse number by the difference between the statistical value of the measured pulse number and the reference pulse number and is stored in the address $A_{12}$ in FIG. 5A. The correction unit thus represents a number of pulses produced during a period, during which an error corresponding to one pulse is produced between the measured pulse number and reference pulse number.

Figure 11:
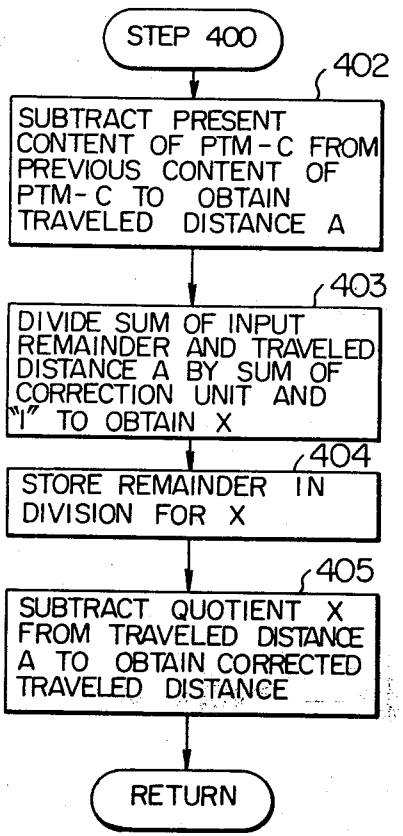

FIG. 11 is a detail flow chart of the step 400 shown in FIG. 6. In this step, the distance covered during the period T is corrected using the correction unit mentioned above.

More particularly, in a step 402 the present content of the PTM-C is subtracted from the content thereof the period T before, and the result is stored as traveled distance A in the address $A_{16}$ shown in FIG. 5. The step 403 is provided for the purpose of accuratly processing the remainder of the division since the pulse number is an integral number. In this step, the quotient X of division of the sum of the remainder of the previous division (stored in the address $A_{14}$ shown in FIG. 5) and the traveled distance A obtained in the step 402 by the sum of the correction unit and "1" is obtained. In a step 404, the remainder produced in the division in the step 403 is stored in the address $A_{14}$ shown in FIG. 5. In a step 405, the quotient X obtained in the step 403 is subtracted from the traveled distance A.

FIG. 12 shows the step 350 shown in FIG. 7. In this step, the data to be stored in the PTM-B is corrected by using the correction unit mentioned above. More particularly, in a step 352 the sum of the data stored in the address shown by the pointer A shown in FIG. 8 and the remainder output obtained in the previous division and stored in the address $A_{13}$ shown in FIG. 5 is obtained and divided by the correction unit. In a step 353, the sum of the quotient Y obtained in the step 352 and the data in the address shown by the pointer A is stored in the latch of the PTM-B. In a step 354, the remainder of the division in the step 352 is stored in the address $A_{13}$.

With the above construction, if the design reference pulse number during the interval between the position signals A and B is 1,000 and the measured pulse number during that interval is 1,100 due to the wear of the sheave 4, the correction unit is 10. In this state, if the car is moved to cover a distance corresponding to 110 pulses during the period T, the traveled distance is corrected to that which corresponds to 100 pulses in the step 400 shown in FIG. 11. Thus, in the steps 420 or 430 shown in FIG. 6 the present car position can always be calculated with high precision irrespective of the wear of the sheave 4. This means that the positioning control can be made with respect to a preset reference value, which is set, for instance as the distance between adjacent floors of a building, at the time of the design.

Also, if it is designed such that an interruption is to be produced after the car under deceleration has covered a distance corresponding to 500 pulses from the previous interruption, in the worn state of the sheave the interruption is produced after the generation of about 454 pulses in terms of the design value set in the PTM-B. In this case, the deceleration is increased, and also accurate landing can no longer be obtained. In accordance with the invention, it is possible to produce interruption when a distance corresponding to 500 pulses at the time of the design is covered due to the execution of the the step 350.

While in the above embodiment the interruption is dealt with in the steps 346, 350 and 370, it is also possible to permit it to be dealt with in the elevator system operation control step 150 by setting a flag. By permitting an urgent job for the interruption process to be effected in a short period of time, it is possible to increase the efficiency of utilizing the microcomputer.

As has been described in the foregoing, since according to the invention precise car position detection can be obtained even if the sheave or like power transmission mechanism is worn in long use, there is no need of renewing the content of the ROM, i.e., floor height data and other data, according to the extent of wear, and thus it is possible to save manhour in the maintenance.

Figure 13:
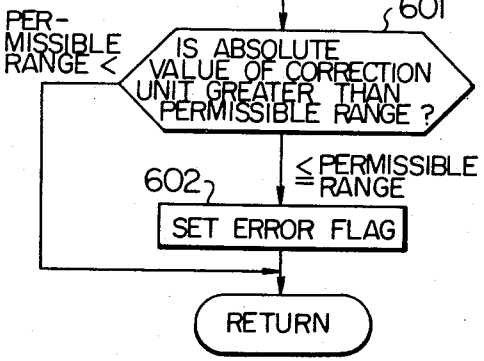

FIG. 13 shows a flow chart of a step 600 for indicating the increase of sheave wear or the like. This step can be included in the step 150 shown in FIG. 4. It consists of a step 601 of inhibiting the execution of a step if the absolute value of the correction unit is greater than a permissible range and the step 602 which is executed for setting an error flag if the absolute value of the correction unit is within the permissible range.

With this construction, when the sheave is worn beyond a limit or when the speed reduction gear is incorrectly mounted at the time of the installation, an error flag is provided and can be utilized for maintenance and inspection.

What we claimed is:

1. In an elevator system comprising an elevator car for traveling to a plurality of floors, motor drive means including a power transmission mechanism for driving said car between floors, pulse generator means coupled to said car through said power transmission mechanism for producing pulses according to the movement of the car and means for calculating the position of the car through the counting of pulses generated from said pulse generator means, a method of accurately detecting the elevator car position, comprising the steps of detecting the number of pulses produced by said pulse generator means during a period during which a predetermined distance is traveled by said car, producing a correction amount in the form of a correction unit by dividing a preset reference value by the difference between the detected number of pulses produced during said period during which a predetermined distance is traveled by said car and said preset reference value, and correcting said car position by substracting the count of said calculating means from a quotient obtained by dividing said count by said correction unit.

2. A method of detecting the elevator car position according to claim 1, wherein the count of said calculating means is modified in accordance with said correction amount at periodic intervals.

3. A method of detecting the elevator car position according to claim 1, wherein the car position is calculated by said calculating means through the comparison of the count of said calculating means and a preset pulse number, and wherein said correcting of the car position comprises modifying said preset pulse number in accordance with said correction amount.

4. A method of detecting the elevator car position according to claim 1, wherein an integral number is obtained as said quotient of division of said count by said correction unit, and the remainder obtained in this division is added to said count at the time of the next division.

5. In an elevator system comprising an elevator car for traveling to a plurality of floors, motor drive means including a power transmission mechanism for driving said car between floors, pulse generator means coupled to said car through said power transmission mechanism for producing pulses according to the movement of the car and means for calculating the position of the car through the counting of pulses generated from said pulse generator means, an apparatus for detecting the elevator car position comprising first and second car detector means for detecting predetermined first and second car positions in a hatchway through which said car travels, means for detecting the number of pulses produced during a period from the actuation of one of said car detector means till the actuation of the other said car detector means, means for memorizing a reference pulse number corresponding to the distance between said first and second car detector means, means for calculating a correction amount by comparison of said detected pulse number with said reference pulse number, and means for correcting said calculated car position provided by said calculating means in accordance with said correction amount.

6. An apparatus for detecting the car position according to claim 5, wherein said car position calculating means includes means for adding or subtracting the number of produced pulses according to the direction of travel of said car and for calculating the car position from the resultant count, and said correcting means includes means for correcting said resultant count by said correction amount.

7. An apparatus for detecting the car position according to claim 5, wherein said car position calculating means includes means having a memory section for memorizing a pulse number corresponding to a predetermined car position to be detected and for calculating the car position through the comparison between said memorized pulse number and the count of said calculating means, and said correcting means includes means for correcting said memorized pulse number by said correction amount.

8. An apparatus for detecting the car position according to claim 5, which further comprises means for producing a signal indicating abnormal wear of said power transmission mechanism when the difference between said detected pulse number and said reference pulse number is in excess of a predetermined value.

* * * * *